US007082910B2

(12) United States Patent
Carlsson et al.

(10) Patent No.: US 7,082,910 B2
(45) Date of Patent: Aug. 1, 2006

(54) TWO-STROKE INTERNAL COMBUSTION ENGINE

(75) Inventors: Bo Carlsson, Floda (SE); Roy Ekdahl, Floda (SE); Hans Ström, Kode (SE)

(73) Assignee: Aktiebolaget Electrolux, Stockholm (SE)

( * ) Notice: Subject to any disclaimer, the term of this patent is extended or adjusted under 35 U.S.C. 154(b) by 642 days.

(21) Appl. No.: 09/952,383

(22) Filed: Sep. 14, 2001

(65) Prior Publication Data

US 2002/0043227 A1 Apr. 18, 2002

Related U.S. Application Data

(63) Continuation-in-part of application No. PCT/SE00/00058, filed on Jan. 14, 2000, and a continuation-in-part of application No. 09/483,478, filed on May 30, 2000, now abandoned, and a continuation-in-part of application No. PCT/SE00/00059, filed on Jan. 14, 2000.

(30) Foreign Application Priority Data

Jan. 19, 1999 (SE) ..... 9900138

(51) Int. Cl.
*F02B 25/20* (2006.01)

(52) U.S. Cl. ..... 123/73 PP; 123/65 P

(58) Field of Classification Search ..... 123/7 EPP, 123/73 AA, 7 EF, 73 FA, 74 AP, 65 S, 65 A, 123/73 PP, 73 F, 65 P
See application file for complete search history.

(56) References Cited

U.S. PATENT DOCUMENTS

| | | | |
|---|---|---|---|
| 968,200 | A | 8/1910 | Scott |
| 980,134 | A | 12/1910 | Springer |
| 1,113,456 | A | 10/1914 | McIntosh |

(Continued)

FOREIGN PATENT DOCUMENTS

| | | |
|---|---|---|
| AT | 394755 B | 11/1991 |
| DE | 420100 | 10/1925 |
| DE | 470603 | 1/1929 |

(Continued)

OTHER PUBLICATIONS

F. W. Lanchester and R. H. Pearsall, The Institution of Automobile Engineers. An Investigation Of Certain Aspects Of The Two–Stroke Engine For Automobile Vehicles, Feb. 1922, pp. 55–62, The Automobile Engineer.

(Continued)

*Primary Examiner*—Marguerite McMahon
(74) *Attorney, Agent, or Firm*—Novak Druce & Quigg, L.L.P.

(57) ABSTRACT

Crankcase scavenged two-stroke internal combustion engine (1), in which a piston ported air passage is arranged between an air inlet (2) and the upper part of a number of transfer ducts (3, 3'). The air passage is arranged from an air inlet (2) equipped with a restriction valve (4), controlled by at least one engine parameter, for instance the carburetor throttle control. The air inlet extends via at least one connecting duct (6, 6') to at least one connecting port (8, 8') in the engine's cylinder wall (12). The connecting port (8, 8') is arranged so that it in connection with piston positions at the top dead center is connected with flow paths (10, 10') embodied in the piston (13), which extend to the upper part of a number of transfer ducts (3, 3'). Each flow path through the cylinder and piston is to a great extent arranged in the cylinder's lateral direction, on the one hand in that the connecting port (8, 8') and adjacent scavenging port (31, 31') of the cylinder are shifted sideways in relation to each other along the periphery of the cylinder wall (12), and on the other hand in that the transfer ducts (3, 3') of the cylinder are running essentially in the cylinder's lateral direction away from each transfer port (31, 31') respectively, i.e. tangentially in relation to the circumference of the cylinder wall (12).

51 Claims, 6 Drawing Sheets

U.S. PATENT DOCUMENTS

| | | | | |
|---|---|---|---|---|
| 1,121,584 | A | 12/1914 | Harper, Jr. | |
| 2,317,772 | A | 4/1943 | Huber et al. | |
| 4,067,302 | A | 1/1978 | Ehrlich | |
| 4,075,985 | A | 2/1978 | Iwai | |
| 4,176,631 | A | 12/1979 | Kanao | |
| 4,248,185 | A | 2/1981 | Jaulmes | |
| 4,253,433 | A | 3/1981 | Blair | |
| 4,306,522 | A | 12/1981 | Fotsch | |
| 4,340,016 | A | 7/1982 | Ehrlich | 123/73 R |
| 4,481,910 | A | 11/1984 | Sheaffer | |
| 4,969,425 | A | 11/1990 | Slee | 123/73 AA |
| 4,987,864 | A | 1/1991 | Cantrell et al. | 123/65 BA |
| 5,379,732 | A | 1/1995 | Mavinahally et al. | 123/73 AA |
| 5,425,346 | A | 6/1995 | Mavinahally | |
| 5,645,026 | A | 7/1997 | Schlessmann | 123/184.46 |
| 5,857,450 | A | 1/1999 | Staerzl | 123/65 S |
| 6,016,776 | A | 1/2000 | Jonsson | 123/65 A |
| 6,085,703 | A | 7/2000 | Noguchi | |
| 6,112,708 | A | 9/2000 | Sawada et al. | |
| 6,216,650 | B1 | 4/2001 | Noguchi | |
| 6,240,886 | B1 | 6/2001 | Noguchi | |
| 6,289,856 | B1 | 9/2001 | Noguchi | |
| 6,318,311 | B1 * | 11/2001 | Kikuchi | 123/73 PP |
| 6,367,431 | B1 * | 4/2002 | Nemoto et al. | 123/65 P |
| 6,497,204 | B1 * | 12/2002 | Miyazaki et al. | 123/73 PP |

FOREIGN PATENT DOCUMENTS

| | | | |
|---|---|---|---|
| DE | 748415 | | 11/1944 |
| DE | 749456 | | 11/1944 |
| DE | 2151941 | | 4/1973 |
| DE | 2650834 | | 6/1977 |
| DE | 3329791 | A1 | 2/1985 |
| DE | 3722424 | A1 | 1/1988 |
| DE | 19857738 | A1 | 7/1999 |
| EP | 0337768 | A2 | 10/1989 |
| EP | 0391793 | A1 | 10/1990 |
| EP | 0971110 | A1 | 1/2000 |
| EP | 0992660 | | 4/2000 |
| EP | 0997620 | A2 | 5/2000 |
| FR | 784866 | | 7/1935 |
| FR | 1434710 | | 2/1966 |
| GB | 2022699 | A | 12/1979 |
| GB | 2130642 | A | 6/1984 |
| JP | 57183520 | A | 11/1982 |
| JP | 56102519 | | 1/1983 |
| JP | 58005423 | | 1/1983 |
| JP | 07269356 | | 10/1995 |
| JP | 2000170611 | | 6/2000 |
| JP | 2000328945 | | 11/2000 |
| JP | 2000337154 | | 12/2000 |
| WO | WO 89 02031 | A1 | 3/1989 |
| WO | WO 9857053 | A1 | 12/1998 |
| WO | WO 0043650 | A1 | 7/2000 |
| WO | WO 00 65209 | A1 | 11/2000 |
| WO | WO 01 25604 | A1 | 4/2001 |
| WO | WO 01 44634 | A1 | 6/2001 |

OTHER PUBLICATIONS

Dr.–Ing. Kurt Blume, Gaiβach, Zweitakt–Gemischspülung mit Spülvorlage, 1972, pp. 475–479, DK 621.43—144.4.058.2, Motortechnische Zeitschrift 74 (1972) 12.

Prof.Dr.H.P.Lenz, Dipl.Ing.G.Bruner, Dipl.Ing. F. Gerstl, Abschluβbericht, zum Forschungsauftrag sur Entwicklung eines Ladungswechselverfahrens mit Spülvorlage für Motorfahrräder, Mar. 1978, pp. 1–16, Tables I–III, Bild 1–17, Z–NR. B0644, Institut für Verbrennungskraftmaschinen und Kraftfahrewsen. Technische Universität Wien.

Dipl.–Ing. Friedrich Gerstl, Dissertation, Massnahmen zur Abgas—und Verbrauchsverbesserung von Kleimvolumigen Zweitakt—Ottomotoren, ausgefuhrt sum Zwecke, der Erlangung des akademischen Grades eines Doktors der technischen Wissenschaften, eingereicht an der Technischen Universitat in Wein, Aug. 1979.

J. Meyer, Air–Head Charge Stratification Of A Two–Stroke Outboard Engine, Mar. 1992, The Queen's University of Belfast, School of Mechanical & Manufacturing Engineering.

Dr. R. Pischinger, 5$^{th}$ Graz Two–Wheeler Symposium, Apr. 22–23, 1993, Heft 65, Technische Universitat Graz, Mitteilungen des Institutes fur Verbrennungskraftmaschinen und Thermodynamik, Belfast, Ireland.

* cited by examiner

TWO-STROKE INTERNAL COMBUSTION ENGINE

CROSS REFERENCE TO RELATED APPLICATIONS

The present application is a (1) continuation-in-part of PCT/SE00/00058 filed 14 Jan. 2000 which designates the United States; (2) a continuation-in-part of U.S. application Ser. No. 09/483,478 filed May 30, 2000 now abandoned and priority is claimed through that application to SE-9900138-0 filed 19 Jan. 1999; and (3) a continuation-in-part of PCT/SE00/00059 filed 14 Jan. 2000 which designates the United States. The disclosures of each of these applications are expressly incorporated herein by reference in their entireties.

BACKGROUND OF INVENTION

1. Technical Field

The subject invention refers to a two-stroke crankcase scavenged internal combustion engine in which one or more piston ported air passages are arranged between one or more air inlets and the upper part or ends of one or more corresponding transfer or scavenging ducts. Fresh air is added at the top of the transfer ducts and is intended to serve as a buffer against the air and fuel mixture located therebelow. This buffer is mainly lost through the exhaust outlet during the scavenging process; the stage after combustion during which the exhaust gases are purged from the cylinder chamber. It is in this manner that the fuel consumption and the exhaust emissions associated with the instant type of two-stroke internal combustion engine design are reduced; that is, there is a reduced amount of uncombusted hydrocarbons exhausted to the atmosphere. That means that there is a more complete utilization of all fuel supplied to the engine, and less unburned and polluting fuel is released to the atmosphere. Engines configured according to the teachings of the present disclosure are particularly appropriate for utilization in handheld working tools because of their high power-to-mass and high power-to-package size characteristics, as well in other suitable applications.

2. Background of the Invention

Two-stroke internal combustion engines of the above mentioned scavenged type are generally known. They beneficially reduce fuel consumption and exhaust emissions; but negatively, the air-to-fuel ratio in such an engine is difficult to control.

U.S. Pat. No. 5,425,346 shows an engine with a somewhat different design than that which is described above. In the design of the '346 patent, channels are arranged in the piston of the engine, which at specific piston positions align with ducts arranged in the cylinder. Fresh air, as shown in FIG. 7, or exhaust gases can thereby be added to the upper part of the transfer ducts. This only happens at the specific and discrete piston positions where the ducts in the piston and the cylinder are aligned, which is also referred to as coming into registration. In fact, registration occurs at two broken apart points in time; one point when the piston moves downwards and a second point when the piston moves upwards. Each, however, occur when the piston is far away from a top dead center position. To avoid unwanted flow in the wrong direction in the latter case, check valves are arranged at the inlet to the upper part of the transfer ducts. The amount of fresh air that can be added is therefore limited because of the short time period that air is supplied and because the presence of the necessary check valve(s) causes substantial resistance to flow when it does occur. These types of check valves, usually referred to as reed valves, however, also have a number of other disadvantages. Such valves frequently have a tendency to come into resonant oscillations causing operational difficulties at high rotational engine speeds which two-stroke internal combustion engines often reach. Still further, the added component of the reed valve adds to the total cost of the engine, as well as increases the number of constituent engine components further complicating the design. In the operation of an engine such as that disclosed in the '346 patent, the amount of fresh air added to the engine is manipulated through the use of a variable inlet; that is, an inlet that can be advanced or retarded in the work cycle. This is, however, is an unnecessarily complicated solution.

International Patent Application PCT/JP98/02478 published under the number WO98/57053 shows a few different embodiments of an engine in which air is supplied to transfer ducts via L-shaped or T-shaped recesses in the piston. Thus, there are no check valves. In all embodiments, however, these piston recesses have, where they meet a respective transfer duct, a very limited height that is essentially equal to the height of the actual transfer port. A consequence of this design is that the passage for air delivery through the piston to the transfer port is opened significantly later than the opening of the passage for the air/fuel mixture to the crankcase by the piston. The period for the air supply is consequently significantly shorter than the period for the supply of air/fuel mixture, where the period can be quantified based on crank angle or time. This can complicate the control of the total air-to-fuel ratio of the engine. This also means that the amount of air that can be delivered to the transfer duct is significantly limited because the underpressure condition utilized to drive this additional air has decreased significantly since the inlet port has already been open during a certain period of time when the air supply is opened. This implies that both the period and the driving force for the air supply are small.

Furthermore, the flow resistance in such L-shaped and T-shaped ducts is relatively high. In general this high resistance to fluid flow therethrough can be attributed to the sharp bend(s) or turns created by the L- and T-shapes, and in the instantly described case, additionally because the cross section of the duct is small close to the transfer port. Regarding the fluid flow associated with these passages, just after the air initially enters the passage, it is forced to change direction abruptly away from a lateral direction with respect to the cylinder to a portion of the passage that is oriented outwards and then immediately downwards through two successive bends or curves, each measuring 90°, in rapid succession. This is due to the fact that the transfer ducts of the engine are running in a radial and vertical direction to the cylinder. In all, this contributes to increasing the flow resistance and to reducing the amount of air that can be delivered to the transfer ducts. A consequence of such a design is that it inhibits the possibilities for reducing the engine's fuel consumption and exhaust emissions.

SUMMARY OF INVENTION

An improved design for a two-stroke internal combustion engine is disclosed herein. There are several aspects or characteristics of the design that individually, and collectively contribute to provide the benefits proposed to be capitalized thereupon. There are, however, several base concepts upon which the inventive design is made. One such concept capitalizes on the characteristic of the two-cycle engine in which the strongest underpressure condition occurs in the crankcase when the piston is in a position approaching a top dead center configuration or orientation.

There is an operational range in which underpressure conditions are experienced that spans from before and until slightly after the piston attains an absolute top dead center position. As a result, the present invention exploits this continuum of this high magnitude underpressure condition and opens a flow channel exposed to an air intake at one end, and which is fluidly connected to the underpressured crankcase at an opposite end.

Moreover, the open configuration of the flow channel is continuously maintained as the piston moves through this underpressure orientation which includes a portion of an up-stroke when the piston is moving toward the absolute top dead center position and a portion of a down-stroke as the piston moves away from that absolute top dead center position. Consequently, not only is more air drawn into the crankcase because of the potentiated underpressure condition found in the crankcase when the piston passes through the top dead center orientation, but the continuous nature of the opening of the flow channel allows the airflow to continue without interruption thereby maintaining a momentum in the flow.

In most basic terms, at least one way according to the present invention for accomplishing such constant flow as the piston passes through the top dead center orientation is to provide a recess in the piston that comes into registration with, and jointly covers two ends of paired air flow ducts. This permits continuous air flow across the recess during the piston's approach toward, and departure away from an absolute top dead center position.

As may best be appreciated from FIGS. 1 and 5, from a structural perspective, the present invention locates a recess on the piston body so that that recess comes into common registration with the air inlet port and the scavenging port and covers at least a portion of each port continuously during at least a portion of the up-stroke and down-stroke of the piston's reciprocating motion. The piston and cylinder are cooperatively arranged so that the recess is in registration with the air inlet port and the scavenging port at a substantially top dead center position of the piston relative to the cylinder. This is comparable to the range of motion experienced around the piston's reaching and departing from absolute top dead center which is referred to herein as a top dead center orientation.

In another aspect which assures optimized coverage of the ports by the recess; dimensionally, a longitudinally measured maximum dimension of the recess is greater than a longitudinally measured maximum dimension taken between an uppermost periphery and a lowermost periphery of a combination of the air inlet port and the scavenging port.

Regarding specific embodiments of the exemplary recess of FIGS. 1–5, the sidewalls of the recess are at least partially curvilinearly shaped. Preferably, certain walls of the recess are substantially straight, but the transition to the bottom surface of the recess from the wall is made in a round or radius. Still further, the recess in these figures is shown as being substantially rectangular in shape, as are the air inlet port(s), and the scavenging port(s).

An alternative way of characterizing the interrelationship of the recess and ports is that the recess is configured to commonly overlay at least a portion of the air inlet port and at least a portion of the scavenging port thereby establishing the flow channel therebetween. The piston and the cylinder are cooperatively arranged so that the common overlay is continuously maintained during at least a portion of both of an up-stroke and down-stroke of the piston's reciprocating motion. Alternatively, this configuration may be characterized as a continuous overlay of at least a portion of each of the air inlet port and the scavenging port during the top dead center orientation or period including both a portion of an up-stroke and a portion of a down-stroke of the piston's reciprocating motion which establishes a continuously open flow channel between the air inlet port and the scavenging port during the period of continuous overlay.

In another aspect, the piston and cylinder of the exemplary two-stroke internal combustion engine of the present invention have been mutually modified to facilitate substantially straight line fluid flow for the air supply where it had before typically undergone a succession of bends and corner turns, usually on right angles or nearly ninety degree bends on the approach to the interface between the cylinder and piston, or on the departure away from the interface. Depending upon the configuration of the flow path established between the piston and cylinder, certain known configurations even include sharp turns at the actual interface between the piston and cylinder by way of square cornered flow channels cut as recesses into the piston's exterior surface.

While actual straight line fluid flow may be considered to be an ideally optimized solution, the present invention capitalizes on the fact that nearly straight line, or only slightly bent or casually curved flow paths enjoy nearly as advantageous fluid flow throughput. In this regard, an optimized fluid flow directional axis labeled "FF" has been indicated in the Figures, and may be particularly appreciated in FIGS. 2 and 7.

In more concise terms, this aspect of the invention may be characterized as a crankcase scavenged two-stroke internal combustion engine that is configured to facilitate fluid flow from an air inlet duct to a scavenging duct. The engine includes a piston that is arranged within a cylinder and that is configured for reciprocating motion therein. An air inlet duct is provided that penetrates the cylinder and terminates in an air inlet port at an interior cylinder wall. A scavenging duct also penetrates the cylinder and terminates in a scavenging port at the interior cylinder wall. As shown, and as is preferred, the air inlet port is located proximate the scavenging port at the interior cylinder wall. The piston has at least one recess, and preferably two or more, that are located in an exterior surface thereof. The recess is positioned on the exterior surface of the piston so that it comes into common registration with the air inlet port and the scavenging port. In this way, a flow channel is established that extends from the air inlet duct, through the air inlet port, across the recess, through the scavenging port and into the scavenging duct. The flow channel is configured to permit straight-line flow from the air inlet duct to the scavenging duct.

As an alternative or variation, the flow channel may be configured to foster what is termed substantially straight-line flow and should be understood to mean that minor turns or bends may be permitted in the flow channel, but only to the extent that they have only negligible effects on the fluid flow that would be experienced if the channel was absolutely straight. That is to say, minor bends, turns and corners are permissible, but only to the extent that only very minor resistances are introduced into the flow system when compared to the straight line configuration that is preferred.

The advantages realized by the present invention are also characterized by the avoidance of sharp curves and bends in the flow path in the proximity of the interface between the piston and cylinder. It may be appreciated from both FIGS. 2 and 7 that the teachings of the present invention call for the flow channel to be flow-facilitating which is achieved by having a flow directional axis free of flow-inhibiting bends and which extends continuously from within said air inlet duct into said scavenging duct. In this same vein, the flow-facilitating flow channel may advantageously have a flow directional axis free of flow-inhibiting bends that depart from a straight line flow by more than 45 degrees, and preferably about 15 degrees, since it may be empirically shown that flow resistance increases in a non-linear relationship, particularly for departures from straight line flow of magnitudes greater than 15 degrees, and especially between 45 and 90 degrees.

Regarding the characterization of the air inlet port as being proximately located to the scavenging port at the interior cylinder wall, at least nearby location of the ports is contemplated, but it is preferred that the air inlet port and the scavenging port be located within the same quarter quadrant of the interior cylinder wall.

In a further aspect, the portion of the flow directional axis (FF) in the air inlet duct is substantially tangentially oriented with respect to the interior cylinder wall at the air inlet port. Similarly, a flow directional axis of the scavenging duct is substantially tangentially oriented with respect to the interior cylinder wall at the scavenging port for facilitating fluid flow through the flow channel. From these orientations, it holds that the flow directional axis of the air inlet duct is oriented substantially parallel to the flow directional axis of the scavenging duct and thereby facilitates fluid flow through the established flow channel.

To affect the above described substantially tangential orientation for the flow channel, and in turn the air flow itself, besides being located proximate to one another, the air inlet duct and the scavenging duct are preferably longitudinally arranged (with respect to the long axis of the cylinder and piston) so that an upper portion of one of the ducts is longitudinally level with a lower portion of the other duct. From a practical stand point, the scavenging duct is normally going to be positioned above the air inlet duct. As a further enhancement, the ducts may be positioned in an overlapping configuration; or optimally, in a side-by-side or level orientation.

In yet another aspect, the present invention may be embodied in a method for providing a fluid flow facilitating crankcase scavenged two-stroke internal combustion engine. The method includes providing a piston that is configured for reciprocating motion within a cylinder. An air inlet port and a scavenging port are provided, each opening at an interior cylinder wall. A recess is located in an exterior surface of the piston and is configured to commonly overlay at least a portion of the air inlet port and at least a portion of the scavenging port thereby establishing a flow channel therebetween. The method continues by arranging the piston with the cylinder to continuously maintain the common overlay during at least a portion of an up-stroke of the reciprocating motion and at least a portion of a down-stroke of the reciprocating motion thereby facilitating fluid flow through the flow channel.

In one aspect, the recess is caused to maintain registration with the air inlet port and the scavenging port substantially at a time when a maximized under-pressure condition is created in a crankcase of the engine.

As intimated above, the piston and the cylinder are cooperatively arranged so that the recess comes into registration with the air inlet port and the scavenging port as the piston approaches a top dead-center position of the piston relative to the cylinder, The recess remains in such registration as the piston departs the top dead-center position thereby establishing a prolonged flow facilitating registration period covering at least a portion of an up-stroke of the reciprocating motion and at least a portion of a down-stroke of the reciprocating motion. In this regard, a top dead center relationship of the piston and the cylinder is defined as generally commencing as the recess comes into registration with the air inlet port and the scavenging port and continues during the continuous maintenance of the common overlay until the recess departs from such registration.

In another aspect, a terminal portion of the air inlet duct leading to the air inlet port is configured, together with a terminal portion of the scavenging duct leading to the scavenging port so that the established flow channel accommodates extension of a straight line thereacross thereby essentially guaranteeing substantially bend-free fluid flow.

Still further, this relationship may be tuned so that the flow channel establishes an essentially tangential fluid flow pattern, with respect to an exterior of the piston, from and through a terminal portion of the air inlet duct and to and through a terminal portion of the scavenging duct.

With respect to straight line flow configurations, a terminal portion of the air inlet duct leading to the air inlet port and a terminal portion of the scavenging duct leading to the scavenging port are configured with respect to each other to have a flow directional axis that deviates from a parallel orientation of one to the other by less than fifteen degrees. Of course, an approximately parallel orientation is preferred, while a coincident orientation is highly preferred for minimized flow resistance characteristics.

As may be appreciated from the alternative schematic orientations of the duct work of the invention, particularly as illustrated by FIGS. 2 and 7, each of the terminal portions of the air inlet duct and the scavenging duct are configured relative to each other to have an effective length measured along the respective flow directional axis of each duct that is greater than a maximum depth of the recess into the piston. Preferably, the relationship will be greater than twice a maximum depth of the recess into the piston.

Collectively, these arrangements are considered to provide flow channel means for facilitating fluid flow therethrough from an air inlet duct to a scavenging duct.

In another aspect, a new arrangement for a crankarm pin is disclosed with particular reference being made to FIGS. 6 and 7. From these depictions, it may be appreciated that a lengthwise abbreviated crankarm pin is mounted between a pair of recesses in the piston body. Because the ends of the crankarm pin are anchored further inward from what would otherwise be the internal piston wall, the length of the pin required to make the extension across the interior space of the piston is less. In another beneficial aspect, the illustrated placement of the end portions of the crankarm pin exclusively within the confines of the pair of recesses assures that no extra length is required in the piston's body height for the pin's accommodation. This reduces the overall length of the piston, and therefore enables a corresponding reduction in package size and weight of the two-stroke internal combustion engine that incorporates this crankarm pin configuration. This is a significant advantage in view of the fact that package size and weight are always of utmost concern, especially in such applications as hand tools where user fatigue will be commensurately reduced by any reductions in these characteristics of the powering two-stroke internal combustion engine.

In still another aspect, the present invention teaches a configuration in which because at least one connecting port in the engine's cylinder wall is arranged so that it is in connection with piston positions at the top dead center and is connected with flow paths embodied in the piston, the supply of fresh air to the upper part of the transfer ducts can be arranged entirely without check valves. This can take place because for piston positions at or near the top dead center, there is an underpressure in the transfer duct in relation to the ambient air. Thus, a piston ported air passage without check valves can be arranged, which is a big advantage. Because the air supply has a very long period, a substantial amount of air can be delivered so that a high exhaust emissions reduction effect can be achieved. Control is applied by means of a restriction valve in the air inlet, controlled by at least one engine parameter. Such control is of a significantly less complicated design than a variable inlet. The air inlet has preferably two connecting ports, which in one embodiment of the invention, are located so that the piston is covering them at its bottom dead center. The restriction valve can suitably be controlled by the engine speed, alone or in combination with another engine parameter.

In yet another aspect, the invention takes the form of a combustion engine configured so that the air passage is arranged from an air inlet equipped with a restriction valve, controlled by at least one engine parameter such as the carburetor throttle control. The air inlet is provided via at least one connecting duct channeled to at least one connecting port in the cylinder wall of the engine that is arranged so that it, in connection with piston positions at the top dead center, is connected with flow paths embodied in the piston. These flow paths extend to the upper part of a number of transfer ducts, and each flow path in the cylinder and piston is to a great extent arranged in the cylinder's lateral direction. In one aspect, the connecting port and adjacent scavenging port of the cylinder are shifted sideways in relation to each other along the periphery of the cylinder wall. In other aspect, the transfer ducts of the cylinder are essentially running in the cylinder's lateral direction away from each scavenging port respectively. This configuration may be characterized as being of a tangential nature relative to the circumference of the cylinder wall. By this arrangement a flow of air through the cylinder with very few and moderate curves is achieved, thereby achieving low flow resistance.

BRIEF DESCRIPTION OF DRAWINGS

FIG. 7 also schematically shows the cylinder as being at least partially hollowed and with a crank-arm pin anchored predominantly between the two recesses in the piston.

DETAILED DESCRIPTION

Figure 1:
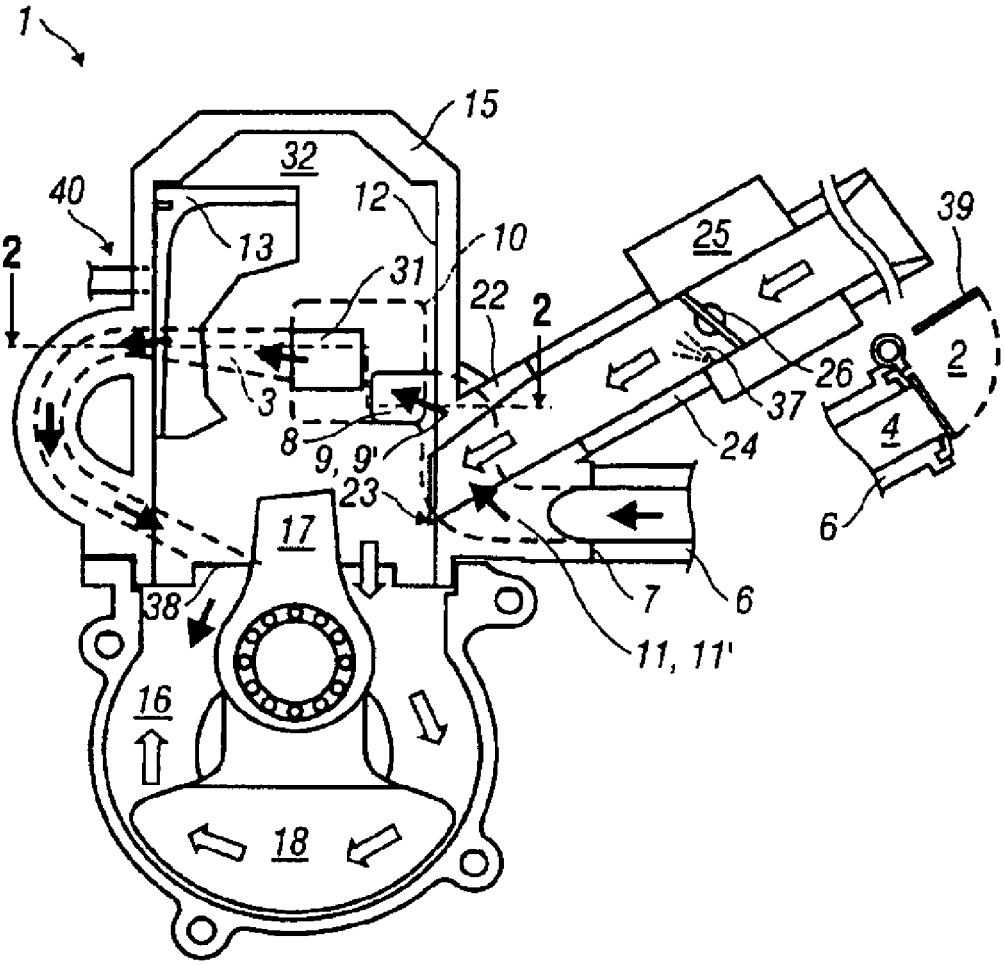
FIG. 1 is an essentially bisected elevational cut-away view of a two-stroke internal combustion engine configured according to the teachings of the present inventions; certain components are shown in partial cut-away for clarity.

The inventions will be described in greater detail and by way of various embodiments thereof with reference to the accompanying drawing figures. For parts that are symmetrically located on the engine, the part on the one side has been given a numeric designation while the part on the opposite side has been given the same numeric designation, but with a prime (') symbol appended thereto. In general, when referring to the drawings, the corresponding parts designated with a prime symbol are located above the plane of the paper and are therefore not expressly shown in some views.

In FIG. 1, an internal combustion engine 1 is shown configured according to the teachings of the presently disclosed invention(s). It is of the two-stroke type and has transfer or scavenging ducts 3, 3'. The transfer duct 3' is not visible in this figure because it would be located above the plane of the paper. The engine 1 has a cylinder 15 and a crankcase 16, a piston 13 with a connecting rod 17 and a crank mechanism 18. Furthermore, the engine 1 has a air/fuel mixture inlet tube 22 that terminates at an interior wall of the cylinder 15 in a air/fuel inlet port 23. The inlet tube 22 is connected to an intermediate section 24 upon which a carburetor 25 is provided together with a throttle valve 26. Fuel 37 is supplied by way of the carburetor 25 to the inlet tube 22. As in typical configurations, the carburetor 25 may be exemplarily connected to an inlet muffler, including a filter; but neither of these components are shown for the sake of clarity.

A schematically represented exhaust duct 40 is shown, and should be accepted as being of conventional design. In application, such an exhaust duct 40 is typically connected to a muffler of the engine 1 for post treatment, particularly for noise minimization. The exhaust duct 40 and related components should be considered to be generally located on the opposite side of the cylinder 15 from the air/fuel inlet 23.

The piston 13, as shown, has a substantially planar upper side or surface without any step or other modification, and it co-operates with the cylinder ports wherever they are located around the periphery of an interior cylinder wall 12. The height of the engine 1 remains substantially unchanged in comparison with a conventional engines of similar type. The transfer or scavenging ducts 3 and 3' have scavenging ports 31 and 31' located in the engine's cylinder wall 12. The engine has a combustion chamber 32 with a spark plug, which is not shown, configured substantially according to conventional design and therefore requiring no further detailed comment.

One special aspect of the presently disclosed invention(s) is the inclusion of an air inlet 2 that is equipped with a restriction valve 4, all of which is arranged so that fresh air can be supplied to the cylinder 15. The air inlet 2 has a connecting duct 6 channeled to the cylinder 15. Intermediately, the connecting duct 6 splits into multiple branch extensions 11, 11', exemplarily two, and then continues on air inlet ducts 9, 9' that terminate at the connecting or air inlet ports 8, 8'. This conduit formed substantially at the cylinder 15 is equipped with an outer connecting port 7. Henceforth in the present description, is should be understood that the term "connecting port" is utilized to mean the port of a connection on the inside of the cylinder, while a corresponding port on the outside of the cylinder 15 will be generally referred to as an "outer connecting port." The air inlet 2 suitably connects to an inlet muffler with a filter, so that cleaned fresh air may be taken in by the engine 1. If the air quality requirements of an engine are however lower, this is not necessary. In any event, the inlet muffler has not been shown for the sake of clarity in the present disclosure.

A terminal end of the connecting duct 6 is advantageously connected to the outer connecting port 7. At or after the port 7, the air duct divides into two branches 11, 11' as described above which each lead respectively to a connecting port 8, 8' exemplarily located symmetrically about the engine 1. The outer connecting port 7 is located under the inlet tube 22 thereby deriving a number of advantages such as lower air temperature upon intake and a better utilization of space resulting in a more compact engine that is well suited for incorporation into a handheld working tool, such as a power saw, that usually also carries a fuel tank.

Alternatively, the outer connecting port 7 can also be located above the inlet tube 22, and would then be directed more horizontally toward the engine's 1 cylinder 15. Regardless of the relative locations of these inlets 6, 22, utilization can be made of the outer or terminal connecting ports 7, 7' and each can be variably or similarly configured. In this way, the ports could even be located at the sides of the inlet tube 22, essentially level therewith.

Flow paths 10, 10' are arranged in the piston 13 so that each, in connection with piston positions at and around top dead center, connect respective connecting ports 8, 8' to upper parts or ends of corresponding transfer ducts 3, 3'. The flow paths 10, 10' are established by means of local recesses 10, 10' in the piston 13. The piston 13 may be simply manufactured, usually by casting, with these local recesses 10, 10' being simultaneously formed therein.

Exemplarily, the connecting ports 8, 8' are located with respect to an axial direction of the cylinder 15 so that the piston 13 covers the ports 8, 8' when in a bottom dead center position. Because of this covering by the piston 13, exhaust gases cannot penetrate into the connecting ports 8, 8', nor further backwards toward an air filter where provided. Alternatively, the connecting ports 8, 8' may be located sufficiently high on the cylinder 15 so that each, to some extent, may be partly open when the piston 13 is located in the bottom dead center configuration. Such an arrangement may be variably adapted so that a desirable amount of exhaust gas is supplied back into the connecting duct 6. Such a high positioning of the connecting ports can also reduce the fluid flow resistance to air at the changeover from connecting port 8, 8' to the scavenging ports 31, 31'.

The period of air supply from the connecting ports 8, 8' to the scavenging ports 31, 31' is important and is to a great extent determined by the configuration of the flow paths or recesses 10, 10' in the piston 13.

Preferably an upper edge of the recess 10, 10' is located sufficiently high so that, when the piston 13 is moving upwards from a bottom dead center position, the upper edge of the recess 10, 10' reaches a lower edge of the respective scavenging port 31, 31' at the same time or earlier than a lower edge of the piston 13 reaches up to a lower edge of the air/fuel inlet port 23. In this way, the air connections, by and through the recesses 10, 10', are opened between the connecting ports 8, 8' and the scavenging ports 31, 31' at the same time or earlier than the air/fuel inlet 23 is opened. When the piston 13 moves down again away from the top dead center position, the air connection 2 will be shut off at the same time or later than the air/fuel inlet 23. In this manner, the air supply has an essentially equally long, or longer period than the air/fuel inlet as counted in crank angle or time. This reduces air flow resistance.

Often it is desirable that the air/fuel inlet period and the air inlet period are essentially equally long. For operational purposes, the air period has been empirically assessed to have an optimized period of approximately 93% of the air/fuel inlet period, with several discrete ranges positioned thereabout and each indicating a series of expanding stepped bandwidths including 90%–110%, 85%–115% and 80%–120% of the air/fuel inlet period. Empirical data supporting these expanding bandwidths is graphically represented in FIG. 8. It should be appreciated that these periods are limited by the maximum period during which the pressure is sufficiently low in the crankcase to enable inflow. For this reason, both periods are preferably maximized and of equal length.

The position of the upper edge of the recess 10, 10' thus determines how early the recess 10, 10' will connect with each scavenging port 31, 31' respectively. Consequently, the recess 10, 10' has an axially or longitudinally measured height, at least locally at the scavenging port31, 31', that is approximately one to one and one-half times the height of the respective scavenging port 31, 31', but which is preferably greater than two times the height of the scavenging port 31, 31'. Under this condition, the scavenging port 31, 31' has a typical height causing the upper side of the piston 13, when located in a bottom dead center position, to be level with the underside of the scavenging port 31, 31', or protruding only slightly thereabove.

The recess 10, 10' is preferably shaped at a lower portion thereof in such a way that the connection or overlay between the recess 10, 10' and the connecting port 8, 8' is maximized since such a configuration reduces the flow resistance therebetween. Accordingly, when the piston 13 is located substantially in a top dead center position, the recess 10, 10' preferably reaches so far down that it covers the connecting port 8, 8' entirely as shown in FIG. 1. As a whole, this means that the recess 10, 10' in the piston 13 that meets a connecting port 8, 8' has an axial or longitudinal height locally at the connecting port 8, 8' that may be between one and one and one-half times the height of the connecting port 8, 8', but which is preferably at least one and one-half times greater, and most preferably about two times the height of the connecting port 8, 8'.

The relative location of the connecting port 8, 8' and the scavenging port 31, 31' can be varied considerably provided that the ports 8, 8' and 31, 31' are only shifted sideways; that is, in the cylinder's 15 lateral or tangential direction, and not axially (above and below) away from one another. Preferably, however, a paired connecting and scavenging port 8, 31 or 8', 31' are retained proximate to one, which may preferably be considered to mean within the same quarter quadrant or one-forth of the cylinder 15. This proximate location of a pair of ports 8, 31 or 8', 31' facilitates the establishment of the minimized flow path described herein.

FIG. 1 illustrates a case in which a paired connecting port 8, 8' and scavenging port 31, 31' has a longitudinal or axial overlap; that is, the upper edge of the connecting port 8, 8' is located as high or higher in the 15 cylinder's axial direction as the lower edge of the scavenging port 31, 31'. At least one advantage of this configuration is that the paired ports 8, 8' and 31, 31' are more laterally or side-by-side aligned with each other in an arrangement of this kind. This reduces the flow resistance when air is being transported from the connecting port 8, 8' to the scavenging port 31, 31'. Consequently, more air can be transported, which enhances the positive effects of this arrangement; among others, reduced fuel consumption and improved exhaust emissions. Though not illustrated, for many two-stroke engines, the piston's 13 upper side or surface is level with a lower edge of the exhaust duct 40 and lower edge of the scavenging port 31, 31' when the piston 13 is at a bottom dead center position. It is, however, also quite common for the piston 13 to extend slightly above the scavenging port's 31, 31' lower edge. If the lower edge of the scavenging port 31, 31' is further lowered, an even greater axial overlap will be created between the connecting port 8, 8' and the scavenging port 31, 31'. When air is supplied to the scavenging duct 31, 31', the flow resistance is resultingly reduced due to the ports 8, 8' and 31, 31' being more level with each other and also to the greater open area of the scavenging port 31, 31'.

Above, the importance is pointed out of having a long period of air supply in order to achieve a low flow resistance at the changeover between cylinder 15 and piston 13. Furthermore, the advantage is pointed out that the connecting port 8, 8' is located as high or higher in the cylinder's 15 axial direction as a lower edge of each scavenging port 31, 31'. This contemplates the possibility of the connecting port 8, 8' and the scavenging port 31, 31' being shifted sideways in relation to each other along the periphery of the cylinder wall 12. When in such a laterally spaced apart or side-by-side configuration, the transition from connecting port 8. 8' to scavenging port 31, 31 via the recess 10, 10' in the piston 13 can occur in a slightly upward, as well as lateral direction with respect to the cylinder 15 or piston 13. If the connecting port 8,8', instead had been located directly below scavenging port 31, then the transition would have occurred in a generally upward direction. Historically, the result of such a configuration has been that the air flow path first turns upward, and then after reaching the scavenging port 31, 31', turn into a horizontal direction. That is, the air flow necessarily detrimentally would undergo two sharp successive turns. Owing to the fact that the ports 8, 8' and 31, 31' are shifted sideways in disclosed embodiments of the present invention(s), a slightly upwardly directed flow is caused, with small or negligible turns.

As earlier described, it is of significant advantage for the transfer ducts 3, 3' to be arranged essentially in the cylinder's 15 lateral direction. The result is that the slightly upwards flow from the connecting port 8, 8' to the scavenging port 31, 31' causes only a slight turn in the air flow which then continues in a substantially straight, lateral direction out in the transfer duct 3 immediately downstream from the scavenging port 31, 31'. As shown in the illustration of FIG. 1, transfer duct 3, 3' runs substantially in the cylinder's 15 lateral direction until the transfer channel reaches the backside of the cylinder portion of the engine 1 and takes a soft turn downward for connection to the crankcase at the transfer channel's mouth 38.

Preferably each branch 11, 11' leading to each connecting port 8, 8', respectively, is configured so that the branch 11, 11' is directed in the cylinder's 15 lateral direction, or slightly upwards from this. In the illustrated embodiment, each branch arrives obliquely from below at an outer connecting port 7. As a result, the branch 11, 11' first turns upwards after the outer connecting port 7 and then continues upwards and turns into a lateral direction upstream of the connecting port 8, 8' in the cylinder wall 12. At the transition from cylinder 15 to piston 13, a slightly upward direction of the flow may be caused which is then slightly turned into a straight lateral flow direction in the transfer duct 3, 3'. Since the connecting port 8,8' is located at a lower level than the scavenging port 31, 31', this is a natural consequence in the illustrated arrangement of FIG. 1. But it is also possible to place one or two outer connecting ports 7 above the inlet components 22–25. If such an arrangement is affected, the air inlet is preferably angled more in the cylinder's 15 lateral direction than is shown in the illustrations. In this alternative configuration, an arrangement may be established in which each branch 11, 11' is directed essentially in the cylinder's lateral direction up to connecting port 8, 8'.

Figure 2:
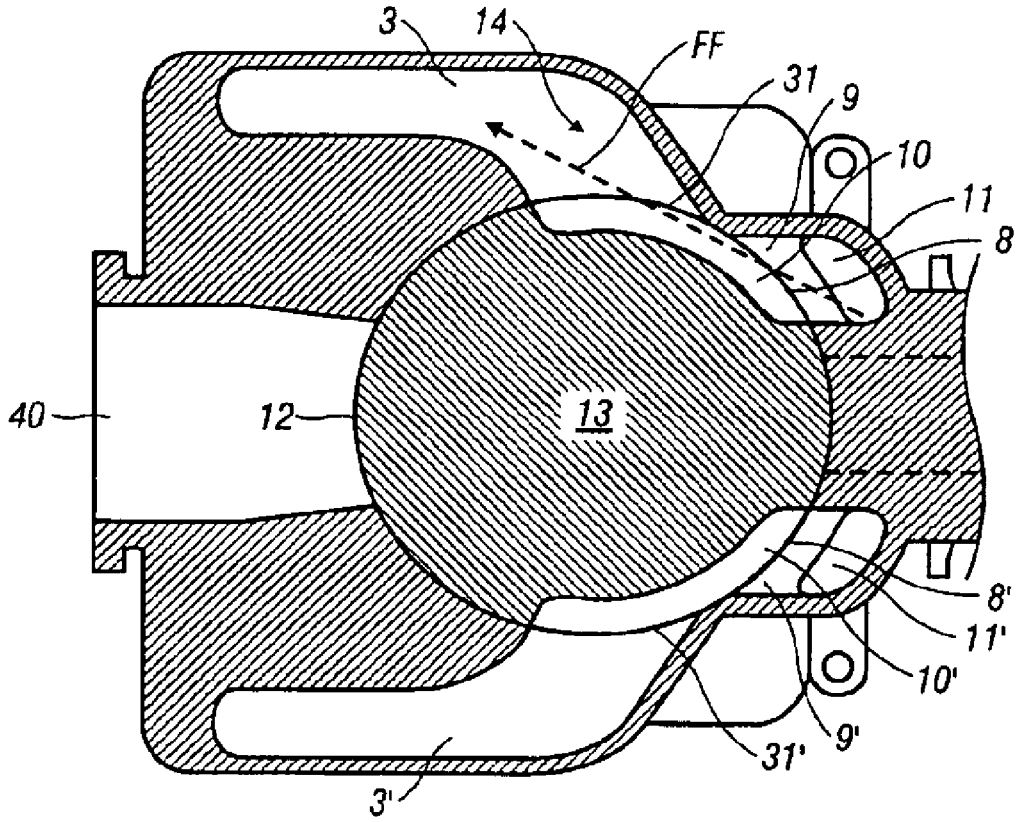
FIG. 2 is a cross-sectional view taken along the sectional line 2—2 indicated in FIG. 1 showing a schematic of several components of the instant two-stroke internal combustion engine, including representations of the piston, cylinder and associated fluid flow passages embodied therein.

In FIG. 2, the flow path, FF, may be appreciated from a top plan view originating from the outer connecting port 7 to the connecting port 8, through the flow path or recess 10 and over to the scavenging port 31 and further on to the transfer duct 3. From this depiction, it becomes apparent that the transfer duct 3, immediately away from the scavenging port 31, is running in an essentially tangential direction in relation to the cylinder 15. Substantially the same tangential orientation is also valid for the first part of the branch 11 upstream from the connecting port 8. In this manner, changes of air flow direction are substantially reduced, if not eliminated, as the air passes from the branch 11 through the piston recess 10 and into the transfer duct 3.

FIG. 2 illustrates a flow channel 14 that extends from the air inlet duct 9, through the air inlet or connecting port 8, across the recess 10, through the scavenging port 31 and into the scavenging or transfer duct 3. The straight-line fluid flow, FF, through the flow channel 14 is also schematically depicted.

Figure 3:
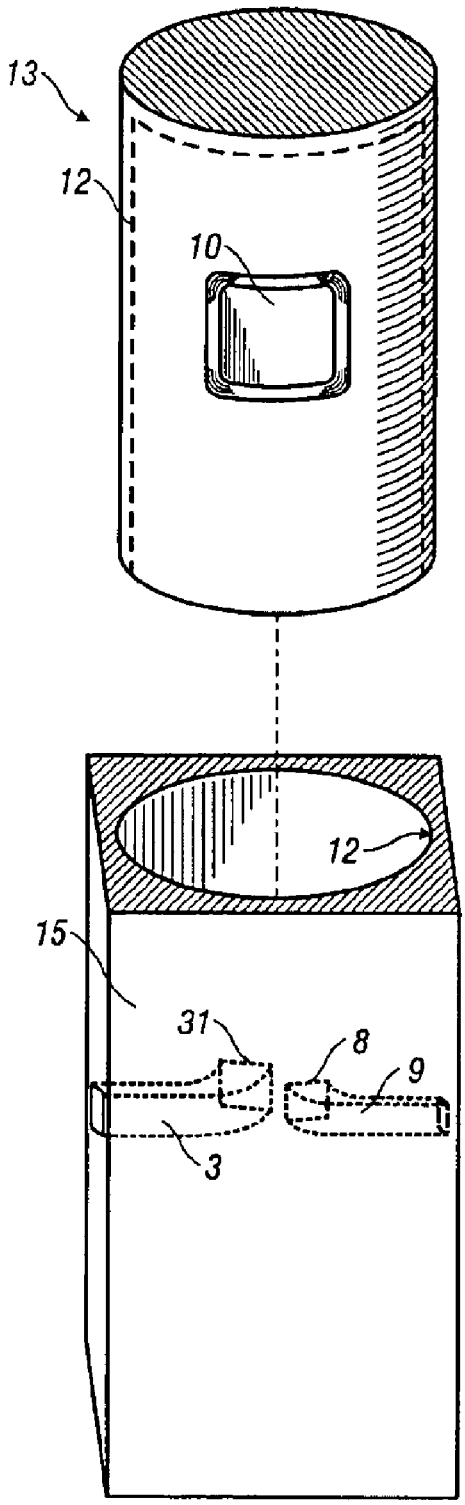
FIG. 3 is a schematic view, shown in an exploded configuration, illustrating the cooperative relationship between several ducts in the cylinder and an associated recess in the piston.
Figure 4:
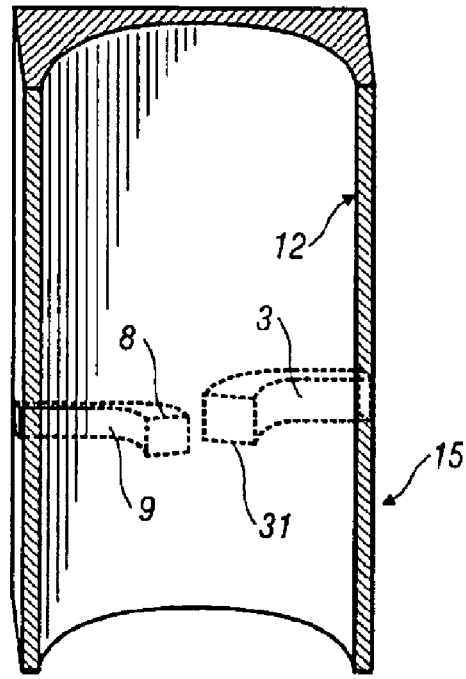
FIG. 4 is a schematic view illustrating simplifications of the duct-work and associated exit ports embodied within the cylinder of the engine.
Figure 5:
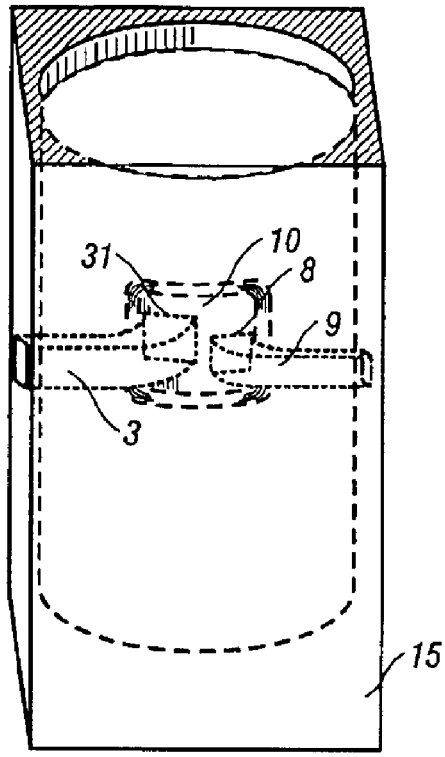
FIG. 5 illustrates an assembled configuration of the piston and cylinder when the recess is in registration with two corresponding ducts from the cylinder.

FIGS. 3–5 schematically illustrate simplified versions of the cooperative configurations embodied in primary aspects of the present invention(s). FIG. 3 shows the interacting duct work including the air inlet duct 9 and the scavenging duct 3, as well as each duct's 9, 3 respective air inlet port 8 and scavenging port 31. The canting of the ports 8, 31 toward one another on the interior cylinder wall 12 can be best appreciated in the internal view of the cylinder 15 depicted in FIG. 4. FIG. 5 shows an assembled view from which the cooperative nature of the recess 10, together with the ducts 9, 3 and ports 8, 31 may be appreciated as they establish the flow channel 14.

Figure 6:
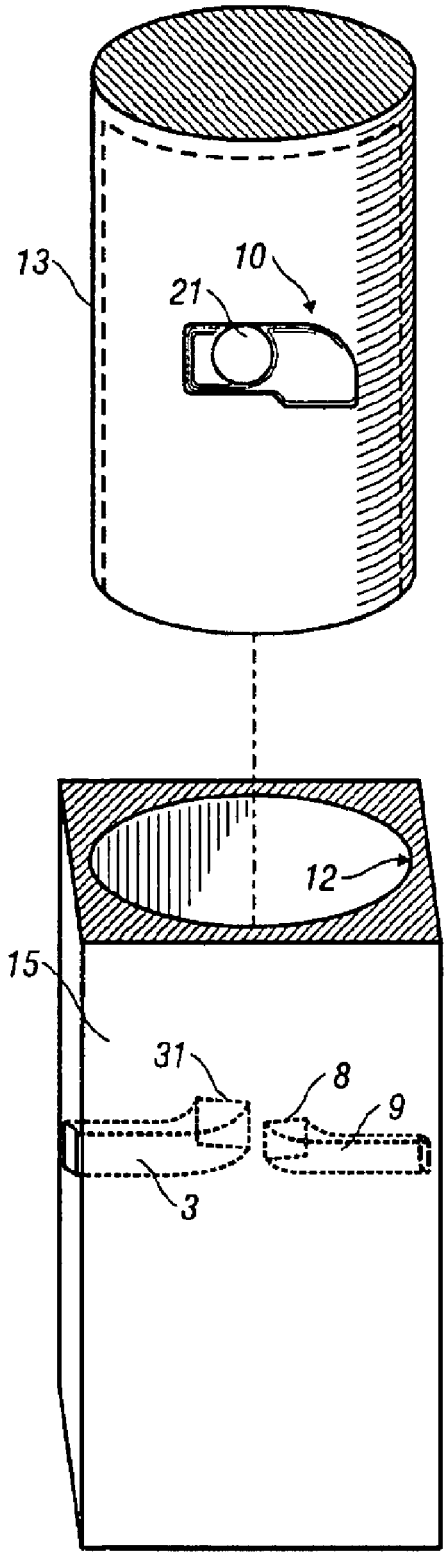
FIG. 6 illustrates an alternative embodiment for the recess in the piston as compared to that shown in FIG. 3.
Figure 7:
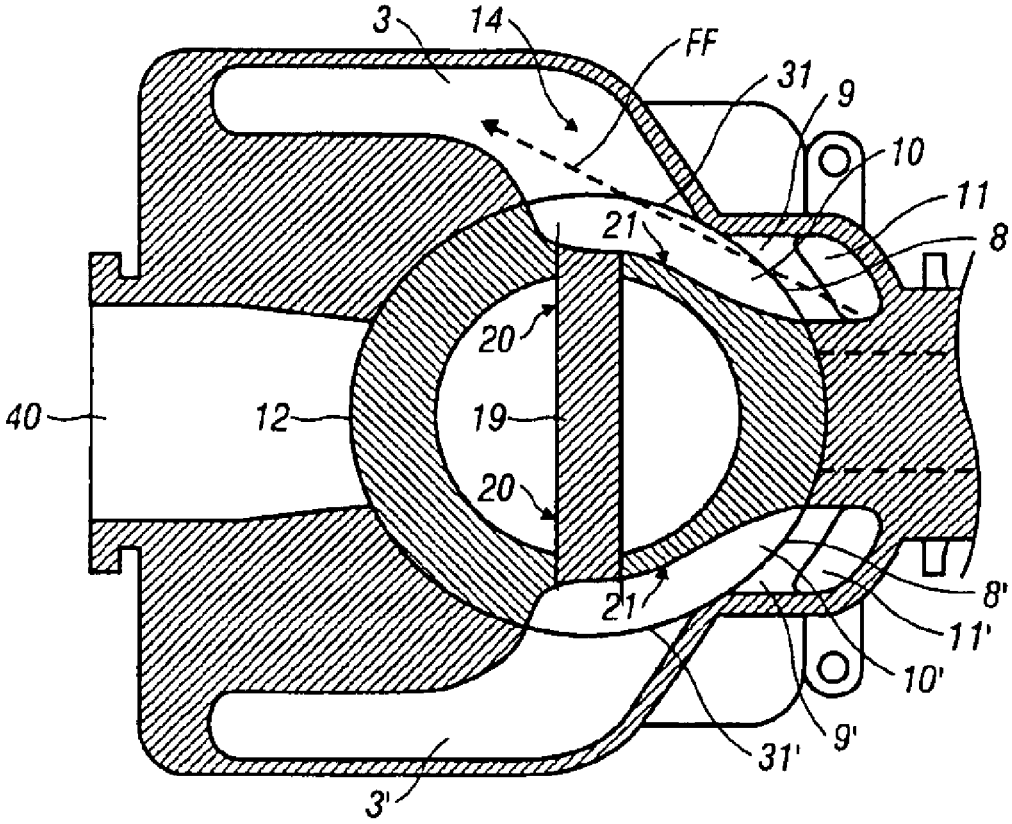
FIG. 7 is a substantially cross-sectional view of the alternative configuration for the recess that is shown in FIG. 6.

Regarding FIGS. 6 and 7, an alternative arrangement of the piston 13 is disclosed. Therein, a piston arrangement 10 is shown that is configured for utilization in a crankcase scavenged two-stroke internal combustion engine 1. The piston arrangement 10 includes a piston body that has a pair of alternatively configured recesses 10 located in an exterior surface thereof and each being configured to facilitate fluid flow from an air inlet duct 9, 9' to a scavenging duct 3, 3' of a crankcase scavenged two-stroke internal combustion engine 1. An elongate crankarm pin 19 is mounted in an interior space within said piston body. The crankarm pin 19 has two ends 20, each of which are anchored in the piston body at a longitudinal axial position at least partially on-level with the recesses 10. It should be appreciated that this configuration is also new with respect to just one recess 10 and therefore is considered an invention from a manufacturing perspective. In the illustrated embodiment, the crankarm pin 19 is positioned at least partially on-level with the pair of recesses 10. Each of the two ends of the crankarm pin 19 terminate in an end surface 21. The crankarm pin 19 is anchored between the pair of recesses 10 and at least a portion of each of the end surfaces 21 of the crankarm pin 19 forming at least a portion of a bottom surface of one or both of the pair of recesses 10 into which the crankarm pin end 20 is anchored. As illustrated, an entirety of the crankarm pin 19 is located between the pair of recesses 10 and is configured so that each of the end surfaces 21 of the crankarm pin 19 forms a portion of a bottom surface of the pair of recesses 10 into which the crankarm pin 19 end is anchored.

While the drawings have been simplified to focus on the primary aspects of the invention, it should be appreciated that the piston 13 is hollowed, though not usually to quite such a regular cylindrical tubular as shown. There is also going to typically be a certain build-up of material about the ends of the crankarm pin for support thereof. Still further, an adequate clearance space must be provided about the pin 19 that facilitates the necessary action of the crank mechanism's rotation about the pin 19.

Referring again to FIGS. 6 and 7, a unique design and configuration of the recess 10 may be appreciated. As shown, the recess 10 is excavated deeper into the body of the piston 13 at one end, exemplarily shown as that end that comes into registration with the scavenging port 31, and then transitions to a flared end that gradually becomes more shallow with respect to the piston body 13. This shallow portion is exemplarily shown as that part of the recess 10 that moves into registration with the air inlet port 8. As may be best appreciated from FIG. 7, at this shallowing end, the bottom surface of the recess 10 is substantially tangentially oriented with respect to the piston 13 and interior cylinder wall 12. Because of such a configuration of the recess 10 as shown in FIGS. 6 and 7, straight-line flow, and particularly tangential flow is achievable through the flow channel 14 as defined herein. The capability for achieving these flow characteristics is further enhanced by the canted configuration of the air inlet duct 9 and scavenging duct 3 as illustrated in each of the several FIGS. 2–7.

Figure 8:
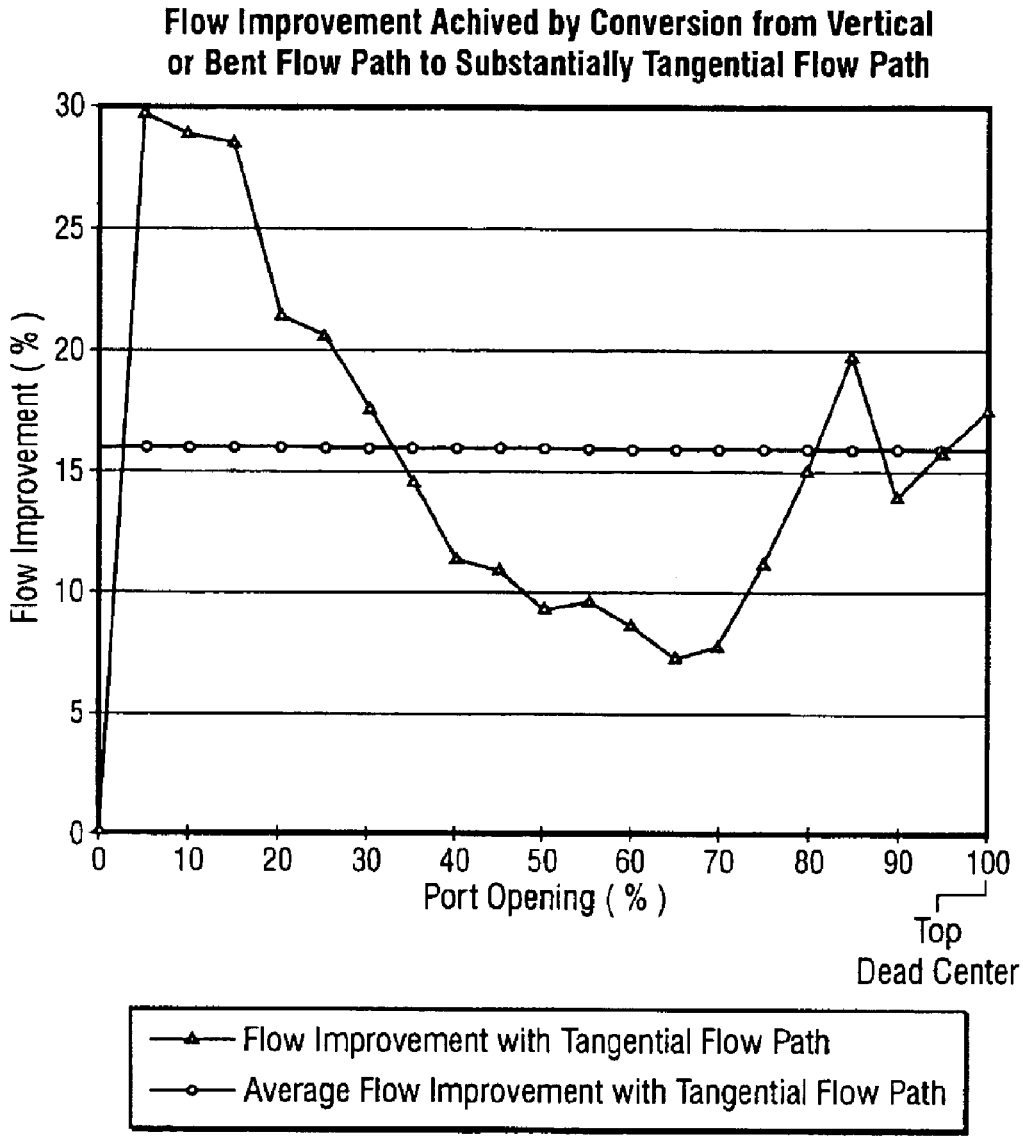
FIG. 8 depicts an illustrative graph showing exemplary flow improvements, on a percentage basis, for fluid flow through air passages configured according to the present invention in comparison to bent fluid flow passages such as those having approximately 90 degree bend(s) along their length.

FIG. 8 illustrates empirical data collected with respect to achieved flow improvement through the utilization of piston 13 and cylinder 15 configurations according to the teachings of the presently disclosed inventions when compared to conventionally designed two-stroke crankcase scavenged internal combustion engines. From this data analysis, it may be appreciated that experimentally, the disclosed configuration(s) provide, on average, a sixteen percent better fluid flow through the newly configured flow channel 14.

What is claimed is:

1. A crankcase scavenged two-stroke internal combustion engine comprising:

a piston arranged within a cylinder and configured for reciprocating motion therein;

a piston ported air passage arranged between an air inlet and an upper part of each of a plurality of transfer ducts;

said air inlet being equipped with a restriction valve controlled by at least one engine parameter and said air inlet extends, via at least one connecting duct, to at least one connecting port in a cylinder wall of the engine;

each of said connecting ports being positioned so that when said piston is in a top dead center orientation, each connecting port is connected with a flow path configured upon the piston and that extends to the upper part of the plurality of transfer ducts; and each flow path in the piston and cylinder is predominantly arranged in essentially a lateral direction with respect to said cylinder as each connecting port and an adjacent scavenging port are arranged sideways in relation to each other along the periphery of said cylinder wall as an associated transfer duct extends essentially in the lateral direction away from the associated scavenging port thereby establishing an essentially tangential relationship between the flow path and a circumference of said cylinder wall.

2. The engine as recited in claim 1, wherein each of a plurality of branches that respectively lead to a connecting port is directed in the cylinder's lateral direction upon approach to said connecting port.

3. The engine as recited in claim 1, wherein each of a plurality of branches that respectively lead to a connecting port is directed slightly upwards with respect to the cylinder's lateral direction upon approach to said connecting port.

4. The engine as recited in claim 1, wherein each flow path is configured so that a recess in said piston that meets a respective scavenging port is arranged so that air supplied from said air inlet is given at least as long a period, measured by crank angle or time, in relation to a fuel mixture inlet.

5. The engine as recited in claim 1, wherein the period of the air supply is approximately ninety-three percent (93%) of the fuel mixture inlet period.

6. The engine as recited in claim 1, wherein the period of the air supply is between ninety (90%) and one hundred and ten percent (110%) of the fuel mixture inlet period.

7. The engine as recited in claim 1, wherein the period of the air supply is between eighty-five (85%) and one hundred and fifteen percent (115%) of the fuel mixture inlet period.

8. The engine as recited in claim 1, wherein the period of the air supply is between eighty (80%) and one hundred and twenty percent (120%) of the fuel mixture inlet period.

9. The engine as recited in claim 1, wherein the recess in the piston that meets the respective scavenging port has an axial height locally at the scavenging port that is greater than one and one-quarter times the height of the respective scavenging port.

10. The engine as recited in claim 1, wherein the recess in the piston that meets the respective scavenging port has an axial height locally at the scavenging port that is greater than one and one-half times the height of the respective scavenging port.

11. The engine as recited in claim 1, wherein the recess in the piston that meets the respective scavenging port has an axial height locally at the scavenging port that is greater than twice the height of the respective scavenging port.

12. The engine as recited in claim 1, wherein an upper edge of a respective connecting port is located at least as high in the cylinder's axial direction as a lower edge of a respective scavenging port.

13. The engine as recited in claim 1, wherein the air inlet has at least two connecting ports in the engine's cylinder wall.

14. The engine as recited in claim 1, wherein each of said connecting ports in the engine's cylinder wall are located to be covered by said piston when positioned in a bottom dead center orientation.

15. The engine as recited in claim 1, wherein each of said connecting ports in the engine's cylinder wall are located to be left at least partially uncovered by said piston when positioned in a bottom dead center orientation so that exhaust gas from the cylinder can penetrate into the air inlet.

16. The engine as recited in claim 1, wherein each of said flow paths in said piston is at least partly are arranged as a recess in the periphery of the piston.

17. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall, said air inlet port located proximate said scavenging port at said interior cylinder wall;

said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct; and said flow channel configured to permit straight-line flow from said air inlet duct to said scavenging duct and a flow directional axis of said air inlet duct being substantially tangentially oriented with respect to said interior cylinder wall at said air inlet port and a flow directional axis of said scavenging duct being substantially tangentially oriented with respect to said interior cylinder wall at said scavenging port for facilitating fluid flow through said flow channel.

18. The engine as recited in claim 17, wherein said proximate location of said air inlet port to said scavenging port at said interior cylinder wall is further characterized as said air inlet port and said scavenging port being located within the same quarter quadrant of said interior cylinder wall.

19. The engine as recited in claim 17, wherein said flow directional axis of said air inlet duct is oriented substantially parallel to said flow directional axis of said scavenging duct for facilitating fluid flow through said flow channel.

20. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall, said air inlet port located proximate said scavenging port at said interior cylinder wall;

said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct; and said flow channel configured to permit substantially straight-line flow from said air inlet duct to said scavenging duct and a flow directional axis of said air inlet duct being substantially tangentially oriented with respect to said interior cylinder wall at said air inlet port and a flow directional axis of said scavenging duct being substantially tangentially oriented with respect to said interior cylinder wall at said scavenging port for facilitating fluid flow through said flow channel.

21. The engine as recited in claim 20, wherein said flow directional axis of said air inlet duct is oriented substantially parallel to said flow directional axis of said scavenging duct for facilitating fluid flow through said flow channel.

22. A crankcase scavenged two-stroke internal combustion engine configured to facilitate fluid flow from an air inlet duct to a scavenging duct, said engine comprising:

a piston arranged within a cylinder and configured for longitudinal reciprocating motion therein;

an air inlet duct penetrating said cylinder and terminating in an air inlet port at an interior cylinder wall and a scavenging duct penetrating said cylinder and terminating in a scavenging port at said interior cylinder wall, said air inlet port located proximate said scavenging port at said interior cylinder wall;

said air inlet duct and said scavenging duct being longitudinally arranged so that an upper portion of one of said air inlet duct and said scavenging duct is longitudinally level with a lower portion of the other of said air inlet duct and said scavenging duct for accommodating fluid flow between said upper and lower portions; and said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct and a flow directional axis of said air inlet duct being substantially tangentially oriented with respect to said interior cylinder wall at said air inlet port and a flow directional axis of said scavenging duct being substantially tangentially oriented with respect to said interior cylinder wall at said scavenging port for facilitating fluid flow through said flow channel.

23. The engine as recited in claim 22, wherein said flow directional axis of said air inlet duct is oriented substantially parallel to said flow directional axis of said scavenging duct for facilitating fluid flow through said flow channel.

24. A crankcase scavenged two-stroke internal combustion engine configured to facilitate fluid flow from an air inlet duct to a scavenging duct, said engine comprising:

a piston arranged within a cylinder and configured for longitudinal reciprocating motion therein;

an air inlet duct penetrating said cylinder and terminating in an air inlet port at an interior cylinder wall and a scavenging duct penetrating said cylinder and terminating in a scavenging port at said interior cylinder wall, said air inlet port located proximate said scavenging port at said interior cylinder wall;

said air inlet duct and said scavenging duct being at least partially longitudinally overlapping with respect to one another; and said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct and a flow directional axis of said air inlet duct being substantially tangentially oriented with respect to said interior cylinder wall at said air inlet port and a flow directional axis of said scavenging duct being substantially tangentially oriented with respect to said interior cylinder wall at said scavenging port for facilitating fluid flow through said flow channel.

25. The engine as recited in claim 24, wherein said flow directional axis of said air inlet duct is oriented substantially parallel to said flow directional axis of said scavenging duct for facilitating fluid flow through said flow channel.

26. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall, said air inlet port located proximate said scavenging port at said interior cylinder wall; and said piston having a recess located in an exterior surface thereof, said recess being positioned on said exterior surface of said piston so that said recess comes into common registration with said air inlet port and said scavenging port and covers at least a portion of each of said air inlet port and said scavenging port continuously during at least a portion of each of an up-stroke of said reciprocating motion and a down-stroke of said reciprocating motion and a flow directional axis of said air inlet duct being substantially tangentially oriented with respect to said interior cylinder wall at said air in let port and a flow directional axis of said scavenging duct being substantially tangentially oriented with respect to said interior cylinder wall at said scavenging port for facilitating fluid flow through said flow channel.

27. The engine as recited in claim 26, further comprising:

said piston and said cylinder cooperatively arranged so that said recess is in registration with said air inlet port and said scavenging port at a substantially top dead-center position of said piston relative to said cylinder.

28. The engine as recited in claim 26, further comprising:

a longitudinally measured maximum dimension of said recess is greater than a longitudinally measured maximum dimension measured between an uppermost periphery and a lowermost periphery of a combination of said air inlet port and said scavenging port.

29. The engine as recited in claim 26, further comprising:

a sidewall of said recess being at least partially curvilinearly shaped.

30. The engine as recited in claim 26, further comprising:

a sidewall of said recess being at least partially curvilinearly shaped between said exterior surface of said piston and a bottom surface of said recess.

31. The engine as recited in claim 26, further comprising:

a bottom surface of said recess being at least partially curvilinearly shaped.

32. The engine as recited in claim 26, further comprising:

a plurality of walls of said recess being at least partially curvilinearly shaped thereby facilitating fluid flow therepast.

33. The engine as recited in claim 26, further comprising:

said recess being substantially rectangular in shape.

34. The engine as recited in claim 26, further comprising:

said recess, said air inlet port, and said scavenging port each being substantially rectangular in shape.

35. The engine as recited in claim 26, further comprising:

said recess, said air inlet port, and said scavenging port each being substantially rectangular in shape, and having rounded corners.

36. A fluid flow facilitating arrangement in a crankcase scavenged two-stroke internal combustion engine for conducting fluid between an air inlet duct and a scavenging duct, said arrangement comprising:

a piston arranged within a cylinder and configured for reciprocating motion therein;

an air inlet port and a scavenging port, each open at an interior cylinder wall;

a recess located in an exterior surface of said piston, said recess configured to commonly overlay at least a portion of said air inlet port and at least a portion of said scavenging port thereby establishing a flow channel therebetween; and said piston and said cylinder cooperatively arranged so that said common overlay is continuously maintained during at least a portion of an up-stroke of said reciprocating motion and at least a portion of a down-stroke of said reciprocating motion and wherein said arrangement is configured so that a flow directional axis of the air inlet duct is substantially tangentially oriented with respect to said interior cylinder wall at said air inlet port and a flow directional axis of the scavenging duct is substantially tangentially oriented with respect to said interior cylinder wall at said scavenging port for facilitating fluid flow through said flow channel.

37. A fluid flow facilitating arrangement in a crankcase scavenged two-stroke internal combustion engine for conducting fluid between an air inlet duct and a scavenging duct, said arrangement comprising:

a piston arranged within a cylinder and configured for reciprocating motion therein;

an air inlet port and a scavenging port, each open at an interior cylinder wall; and a recess located in an exterior surface of said piston, said recess configured to continuously overlay at least a portion of each of said air inlet port and said scavenging port during a period including both at least a portion of an up-stroke of said reciprocating motion and a down-stroke of said reciprocating motion thereby establishing a continuously open flow channel between said air inlet port and said scavenging port during said period of continuous overlay and wherein said arrangement is configured so that a flow directional axis of the air inlet duct is substantially tangentially oriented with respect to said interior cylinder wall at said air inlet port and a flow directional axis of the scavenging duct is substantially tangentially oriented with respect to said interior cylinder wall at said scavenging port for facilitating fluid flow through said flow channel.

38. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall;

said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct; and said flow channel being flow-facilitating and having a flow directional axis free of flow-inhibiting bends and which extends continuously from within said air inlet duct into said scavenging duct and wherein said engine is configured so that a flow directional axis of the air inlet duct is substantially tangentially oriented with respect to said interior cylinder wall at said air inlet port and a flow directional axis of the scavenging duct is substantially tangentially oriented with respect to said interior cylinder wall at said scavenging port for facilitating fluid flow through said flow channel.

39. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall;

said piston having a recess located in an exterior surface thereof, said recess positioned on said exterior surface of said piston so that said recess comes into common registration with said air inlet port and said scavenging port and thereby establishes a flow channel extending from said air inlet duct, through said air inlet port, across said recess, through said scavenging port and into said scavenging duct; and said flow channel being flow-facilitating and having a flow directional axis free of flow-inhibiting bends less than 135 degrees and which extends continuously from within said air inlet duct into said scavenging duct and wherein said engine is configured so that a flow directional axis of the air inlet duct is substantially tangentially oriented with respect to said interior cylinder wall at said air inlet port and a flow directional axis of the scavenging duct is substantially tangentially oriented with respect to said interior cylinder wall at said scavenging port for facilitating fluid flow through said flow channel.

40. A crankcase scavenged two-stroke internal combustion engine configured to facilitate fluid flow from an air inlet duct to a scavenging duct, said engine comprising:

a piston arranged within a cylinder and configured for reciprocating motion therein;

an air inlet duct penetrating said cylinder and terminating in an air inlet port at an interior cylinder wall and a scavenging duct penetrating said cylinder and terminating in a scavenging port at said interior cylinder wall;

said piston including a flow channel means for facilitating fluid flow therethrough from an air inlet duct to a scavenging duct and wherein said engine is configured so that a flow directional axis of the air inlet duct is substantially tangentially oriented with respect to said interior cylinder wall at said air inlet port and a flow directional axis of the scavenging duct is substantially tangentially oriented with respect to said interior cylinder wall at said scavenging port for facilitating fluid flow through said flow channel.

41. A method for providing a fluid flow facilitating crankcase scavenged two-stroke internal combustion engine, said method comprising:

providing a piston configured for reciprocating motion within a cylinder;

providing an air inlet port and a scavenging port, each open at an interior cylinder wall;

providing a recess located in an exterior surface of said piston and configuring said recess to commonly overlay at least a portion of said air inlet port and at least a portion of said scavenging port thereby establishing a flow channel therebetween;

cooperatively arranging said piston with said cylinder to continuously maintain said common overlay during at least a portion of an up-stroke of said reciprocating motion and at least a portion of a down-stroke of said reciprocating motion thereby facilitating fluid flow through said flow channel;

providing an air inlet duct penetrating said cylinder and terminating in said air inlet port at an interior cylinder wall and a scavenging duct penetrating said cylinder and terminating in said scavenging port at said interior cylinder wall; and configuring a terminal portion of said air inlet duct leading to said air inlet port and a terminal portion of said scavenging duct leading to said scavenging port to each have a flow directional axis approximately parallel one to the other.

42. A method for providing a fluid flow facilitating crankcase scavenged two-stroke internal combustion engine, said method comprising:

providing a piston configured for reciprocating motion within a cylinder;

providing an air inlet port and a scavenging port, each open at an interior cylinder wall;

providing a recess located in an exterior surface of said piston and configuring said recess to commonly overlay at least a portion of said air inlet port and at least a portion of said scavenging port thereby establishing a flow channel therebetween;

cooperatively arranging said piston with said cylinder to continuously maintain said common overlay during at least a portion of an up-stroke of said reciprocating motion and at least a portion of a down-stroke of said reciprocating motion thereby facilitating fluid flow through said flow channel;

providing an air inlet duct penetrating said cylinder and terminating in said air inlet port at an interior cylinder wall and a scavenging duct penetrating said cylinder and terminating in said scavenging port at said interior cylinder wall; and configuring a terminal portion of said air inlet duct leading to said air inlet port and a terminal portion of said scavenging duct leading to said scavenging port to each have a flow directional axis that deviates from a parallel orientation, one to the other, less than 15 degrees.

43. A method for providing a fluid flow facilitating crankcase scavenged two-stroke internal combustion engine, said method comprising:

providing a piston configured for reciprocating motion within a cylinder;

providing an air inlet port and a scavenging port, each open at an interior cylinder wall;

providing a recess located in an exterior surface of said piston and configuring said recess to commonly overlay at least a portion of said air inlet port and at least a portion of said scavenging port thereby establishing a flow channel therebetween;

cooperatively arranging said piston with said cylinder to continuously maintain said common overlay during at least a portion of an up-stroke of said reciprocating motion and at least a portion of a down-stroke of said reciprocating motion thereby facilitating fluid flow through said flow channel;

providing an air inlet duet penetrating said cylinder and terminating in said air inlet port at an interior cylinder wall and a scavenging duct penetrating said cylinder and terminating in said scavenging port at said interior cylinder wall; and configuring a terminal portion of said air inlet duct leading to said air inlet port and a terminal portion of said scavenging duct leading to said scavenging port to each have a flow directional axis approximately parallel to a flow directional axis of said flow channel across said recess.

44. The method as recited in any one of claims 41, 42 and 43, further comprising:

causing said recess to maintain registration with said air inlet port and said scavenging port substantially at a time when a maximized under-pressure condition is created in a crankcase of the engine.

45. The method as recited in any one of claims 41, 42 and 43, further comprising:

causing said piston and said cylinder to be cooperatively arranged so that said recess comes into registration with said air inlet port and said scavenging port as said piston approaches a top dead-center position of said piston relative to said cylinder and remains in said registration as said piston departs said top dead-center position thereby establishing a prolonged flow facilitating registration period covering at least a portion of an up-stroke of said reciprocating motion and at least a portion of a down-stroke of said reciprocating motion.

46. The method as recited in claim 45, further comprising:

establishing a top dead center relationship of said piston and said cylinder as generally commencing as said recess comes into registration with said air inlet port and said scavenging port and continuing during said continuous maintenance of said common overlay until said recess departs from said registration.

47. The method as recited in any one of claims 41, 42 and 43, further comprising:

providing an air inlet duct penetrating said cylinder and terminating in said air inlet port at an interior cylinder wall and a scavenging duct penetrating said cylinder and terminating in said scavenging port at said interior cylinder wall; and configuring said air inlet duct and said scavenging duct to be at least partially overlapping with respect to one another in a longitudinal axial direction of said cylinder.

48. The method as recited in any one of claims 41, 42 and 43, further comprising:

providing an air inlet duct penetrating said cylinder and terminating in said air inlet port at an interior cylinder wall and a scavenging duct penetrating said cylinder and terminating in said scavenging port at said interior cylinder wall; and configuring a terminal portion of said air inlet duct leading to said air inlet port, a terminal portion of said scavenging duct leading to said scavenging port, and said flow channel to accommodate extension of a straight line thereacross.

49. The method as recited in any one of claims 41, 42 and 43, further comprising:

providing an air inlet duct penetrating said cylinder and terminating in said air inlet port at an interior cylinder wall and a scavenging duct penetrating said cylinder and terminating in said scavenging port at said interior cylinder wall; and configuring a terminal portion of said air inlet duct leading to said air inlet port, a terminal portion of said scavenging duct leading to said scavenging port, and said flow channel to establish an essentially tangential fluid flow pattern, with respect to an exterior of said piston, from and through said terminal portion of said air inlet duct terminal portion and to and through said terminal portion of said scavenging duct.

50. The method as recited in claim 43, further comprising:

configuring each of said terminal portions of said air inlet duct and said scavenging duct to each have an effective length measured along the respective flow directional axis of said ducts greater than a maximum depth of said recess into said piston.

51. The method as recited in claim 43, further comprising:

configuring each of said terminal portions of said air inlet duct and said scavenging duct to each have an effective length measured along the respective flow directional axis of said ducts greater than twice a maximum depth of said recess into said piston.

* * * * *